US006527372B1

(12) United States Patent
Choi et al.

(10) Patent No.: US 6,527,372 B1
(45) Date of Patent: Mar. 4, 2003

(54) METHOD FOR OPTIMIZING DRIVING INPUT SIGNAL IN AN INK JET HEAD USING SHAPE MEMORY ALLOY

(75) Inventors: Hae Yong Choi, Kyungki-Do (KR); Myung-Song Jung, Kyungki-Do (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 0 days.

(21) Appl. No.: 09/345,329

(22) Filed: Jun. 30, 1999

(30) Foreign Application Priority Data

Dec. 30, 1998 (KR) ..... 98-60639

(51) Int. Cl.[7] ..... B41J 2/04
(52) U.S. Cl. ..... 347/54
(58) Field of Search ..... 347/54, 68, 69, 347/70, 71, 72, 50, 40, 9, 20, 29, 32, 44, 55, 56, 27; 399/261, 700; 310/328–330; 29/890.1; 251/129.1; 216/27

(56) References Cited

U.S. PATENT DOCUMENTS 6,228,668 B1 * 5/2001 Silverbrook ..... 347/56

FOREIGN PATENT DOCUMENTS

JP 2875242 1/1999

* cited by examiner

*Primary Examiner*—Raquel Yvette Gordon
(74) *Attorney, Agent, or Firm*—Darby & Darby

(57) ABSTRACT

Disclosed is a method for optimizing a driving input signal in an ink jet head using shape memory alloy. The method comprising the steps of: (a) determining a voltage inputted when a replacement generating time in a shape memory alloy layer disposed in the ink jet head is minimal, as a reference input voltage; (b) measuring a first time from a reference input voltage supply starting point to a displacement starting point of the shape memory alloy layer; (c) measuring a second time from after the first time measured in step (b) to a point when a displacement of the shape memory alloy layer is maximal; (d) determining a sum of the first and second times which are measured in steps (b) and (c), respectively, as a reference input voltage applying time; (e) calculating energy applied to the ink jet head, on the basis of the reference input voltage and the reference input voltage applying time which are determined in steps (a) and (d), respectively; and (f) determining a waveform of a driving voltage by measuring a firing velocity and a size of ink droplets while variously changing a voltage and a voltage applying time, such that energy less than the energy which is calculated in step (e) is obtained.

7 Claims, 10 Drawing Sheets

METHOD FOR OPTIMIZING DRIVING INPUT SIGNAL IN AN INK JET HEAD USING SHAPE MEMORY ALLOY

BACKGROUND OF THE INVENTION

1. Field of the Invention

The present invention relates to a method for controlling a driving input signal to efficiently utilize an ink jet head using shape memory alloy, and more particularly, the present invention relates to a method for optimizing a driving input signal in an ink jet head using shape memory alloy, which optimizes a waveform of a driving voltage applied to heat the ink jet head, without a structural alteration of the ink jet head driven by being heated and without a change in manufacturing processes for the ink jet head, thereby improving an ink firing characteristic and preventing the ink jet head from being overheated.

2. Description of the Related Art

Generally, printers are divided into a line printing type printer and a page printing type printer depending upon a printing scheme which they adopt. A so-called laser printer is representative of a page printing type printer, and a so-called dot printer or an ink jet printer is representative of a line printing type printer.

Drop-on-demand (DOD) type printer heads which fire liquid ink only under necessity are most widely used for ink jet printers. Use of such DOD type printer heads has gradually increased in that they require no electric charge or deflection of ink droplets and in that since high pressure is not needed, an easy printing is achieved by immediately firing ink droplets under atmospheric pressure.

Typical firing principles of such DOD type printer heads include a heating type firing method using a resistor, a vibration type firing method using a piezoelectric element, and a firing method using shape memory alloy, etc.

A printer head which adopts a heating type firing method generally includes a nozzle plate having a plurality of nozzles, a fluid passage plate coupled onto the nozzle plate and defining an ink storing chamber into which ink is stored, a substrate coupled onto the fluid passage plate and covering the ink storing chamber, and a heating resistor embedded into the substrate.

In an ink firing device of a printer head which adopts a heating type firing method, as shown in FIG. 1, ink is fired as described below.

First, if a predetermined voltage is applied to a heating resistor 14, heat is generated. By the heat generated in the heating resistor 14, air contained in ink adjacent the heating resistor 14 is expanded to create air bubbles. By these air bubbles, ink 16 inside an ink storing chamber 10 is forced out through a nozzle 12 to be fired toward a recording medium.

Accordingly, in the printer head which adopts the heating type firing method, bubbles such as lathers are generated when heat is applied to ink which is filled in the printer head, and the generated bubbles are fired through the nozzle to define a character on a printing sheet. Therefore, in the sense that the printer head uses air bubbles, the printer head is called an ink bubble jet type printer head.

However, the heating type firing method suffers from defects in that since ink is heated by heat generated in the heating resistor 14, the ink is likely to be chemically degraded, and this degraded ink may be deposited onto an inner surface of the nozzle 12 clogging the nozzle 12.

Also, since the heating resistor 14 repeatedly generates heat upon application of a voltage, a lifetime of the heating resistor 14 is shortened, and since only water soluble ink should be used, preserving property for a printed document is deteriorated.

A printer head which adopts a vibration type firing method, is generally similar in its structure to the printer head which adopts the heating type firing method, except that a piezoelectric element is disposed at a position where the heating resistor 14 is disposed in the printer head which adopts the heating type firing method (see FIG. 1).

In an ink firing device of a printer head which adopts a vibration type firing method, as shown in FIG. 2, ink is fired as described below. If predetermined electric power is supplied to a piezoelectric element 24, the piezoelectric element 24 vibrates. By the vibration of the piezoelectric element 24, a volume of an ink storing chamber 20 is momentarily changed, and by this, ink 26 inside the ink storing chamber 20 is forced out through a nozzle 22 to be fired toward a recording medium.

The vibration type firing method using the vibration of the piezoelectric element 24 provides an advantage in that since heat is not used, it is possible to use an ink other than water soluble ink and thereby a greater variety of choices are offered for ink. However, the vibration type firing method is encountered with problems in that since workability for the piezoelectric element 24 is impaired and especially, it is difficult to form the piezoelectric element 24, productivity is reduced.

FIG. 3 is a cross-sectional view schematically illustrating an ink firing device of a printer head which uses shape memory alloy. A shape memory alloy 32 which is in a flexurally deformed state is disposed above an ink storing chamber 30. If the shape memory alloy 32 which is in the flexurally deformed state is heated, the shape memory alloy 32 is returned to its original flattened state after a flexurally deformed portion is smoothed out.

As the shape memory alloy 32 is returned to its original flattened state, a volume of the ink storing chamber 30 is decreased, and according to this, ink supplied through an ink supplying path 38 and stored in the ink storing chamber 30 is fired through a nozzle 36 to a recording device (not shown).

A printer head using shape memory alloy is classified into a first type wherein several shape memory alloy layers having different phase transformation temperatures and different thicknesses are coupled one with another to be flexurally deformed and a second type wherein a shape limiting body 33 and the shape memory alloy 32 are coupled with each other to be flexurally deformed. At this time, a member comprising the shape limiting body 33 and the shape memory alloy 32 which are coupled with each other is called a vibrating plate.

Because printer heads of these types employ shape memory alloy of a plate-shaped configuration which has a thickness of 50–1,000 $\mu$m and an area of 0.1–10 $mm^2$, power consumption is increased upon heating, heating and cooling times are lengthened to decrease operation frequency, and printing speed is lowered thereby deteriorating practicality of the entire printer head.

Moreover, since the shape memory alloy layer is thick and wide, it cannot be instantaneously heated, and displacement is slowly generated over a relatively long period of time. Accordingly, due to the fact that a generated pressure is reduced, ink may not be fired or may not be properly fired. Also, even in the case that ink is fired, because firing speed of droplets is decreased, wetting may be caused and thereby it is difficult to achieve stable firing of the ink due to variations in velocity and size of ink droplets.

In addition, due to the fact that the shape memory alloy layer has a configuration of a plate which is large and thick and therefore, the entire structure thereof cannot but be enlarged, it is difficult to miniaturize the size of the printer head, integration density of nozzles is diminished and printing resolution is deteriorated.

In other words, in the case that the shape memory alloy is used as taught in the conventional art, a pressure chamber of the printer head must be enlarged such that it has a length of 100–10,000 $\mu$m and a width of 50–500 $\mu$m. Accordingly, if a pressure chamber of this size is used, the entire structure of the printer head cannot but also be enlarged.

Besides, since the printer head is constructed in that several shape memory alloy layers which are bonded one with another and bent, or a thin plate-shaped shape memory alloy layer and a shape limiting body which are bonded with each other and bent, are attached by bonding to a main body in which an ink storing chamber is defined, it is difficult to manufacture the printer head, and reliability is declined when the shape memory alloy is applied to the ink jet printer head which is required to be vibrated several ten million times.

Accordingly, as an efficient approach to improve ink firing capability, structures as shown in FIGS. 4 and 5 are disclosed in the art.

FIG. 4 is a plan view schematically illustrating an actuator section of an ink jet printer head using shape memory alloy, recently disclosed in the art, and FIG. 5 is a cross- sectional view schematically illustrating an ink firing device section of the ink jet printer head of FIG. 4.

In the ink jet printer head using shape memory alloy as shown in FIGS. 4 and 5, in order to shorten a heating time while reducing an amount of energy consumed upon heating and securing a volumetric displacement of a pressure chamber such that the volumetric displacement is sufficient to allow the ink jet printer head to fire ink, it is preferred that a width d of a vibrating plate is decreased and a length L' of the vibrating plate is increased. While it is generally preferred that a ratio of the width and the length of the vibrating plate is 1:1–1:7, the ratio can be changed depending upon a printer head used.

When observing operations of the ink jet printer head using shape memory alloy as shown in FIGS. 4 and 5, by the fact that a space part is defined by etching a portion of a substrate 40 to which a shape memory alloy 43 is attached, vibrating plates 41 and 43 are flexurally deformed due to a buckling phenomenon, by compression stress which is remained in a shape limiting body 41, that is, a silicon dioxide layer ($SiO_2$), and are maintained in a flexurally deformed state. At this time, a member comprising the shape limiting body 41 and the shape memory alloy 43 which are bonded with each other, is called the vibrating plate. The shape limiting body 41 is generally made of $SiO_2$, but a metallic material such as $Si_3M_4$, Si, poly silicon, etc. can be used to form the shape limiting body 41 while setting aside $SiO_2$.

If electric power is supplied to the printer head, the electric power is applied to an electrode 44 to generate heat therein, and by the heat generated in the electrode 44, the shape memory alloy 43 which is maintained in the flexurally deformed state is heated. When being heated, the shape memory alloy 43 is willing to return to its original flattened state, and in this course of returning, a volume of a pressure chamber 50 is reduced to fire ink through a nozzle.

On the contrary, if the shape memory alloy 43 is cooled, since a flexural deformation is generated by residual compression stress of $SiO_2$, a volume of the pressure chamber 50 is again increased, and ink is refilled by an amount which is fired.

At this time, because the silicon dioxide layer 41 which is formed on a surface of the substrate, has residual compression stress by which it is willing to flex by itself, it provides the shape memory alloy 43 with restoring force for enabling the shape memory alloy 43 flattened by being heated to be flexurally deformed again while being cooled.

Accordingly, in the printer head using shape memory alloy, these processes are repeated to continuously fire ink, thereby to complete a printing function.

In the ink jet printer head using shape memory alloy operated as described above, while the shape memory alloy layer 43 of the vibrating plate part has a flattened configuration in its original state, it has residual compression stress in the course of forming it as a film onto the substrate by a method such as deposition, etc. Accordingly, it is possible to change a magnitude of the residual compression stress which remains in the shape memory alloy 43, depending upon a deposition condition, and thermal treating temperature and time, etc. when carrying out deposition onto the substrate.

Therefore, most technical approaches for improving efficiency of an ink jet printer head using shape memory alloy by accomplishing adjustment and optimization of an ink firing amount and by preventing the printer head from being overheated, or the like, are related with a structural alteration of the ink jet head and a change in manufacturing processes for the ink jet head.

However, because these approaches for improving efficiency must be necessarily accompanied by modifications or alterations of entire processes or entire structures, although a simulation is performed with great precision, it is impossible to avoid errors by the time when they are perfectly applied in actual practice, and a lengthy period of time is needed to perfectly apply them in actual practice, whereby manufacturing cost is raised and a great deal of effort is required.

SUMMARY OF THE INVENTION

Accordingly, the present invention has been made in an effort to solve the problems occurring in the related art, and an object of the present invention is to provide a method for optimizing a driving input signal in an ink jet head using shape memory alloy, which optimizes a waveform of a driving voltage applied to heat the ink jet head, without a structural alteration of the ink jet head driven by being heated and without a change in manufacturing processes for the ink jet head, thereby improving an ink firing characteristic and preventing the ink jet head from being overheated.

In order to achieve the above object, according to one aspect of the present invention, there is provided a method for optimizing a driving input signal in an ink jet head using shape memory alloy, the ink jet head including a vibrating plate having a shape memory alloy layer and a silicon dioxide layer which are coupled with each other and formed such that it covers space parts which are formed left and right of a substrate, to be vibrated while being changed in its contour depending upon a temperature variation thereof, an electrode formed on the vibrating plate to have a desired pattern, an ink storing chamber defined between the space parts of the substrate for storing ink, a pressure chamber defined on the vibrating plate for containing ink, the pressure chamber discharging ink by vibration of the vibrating plate, a fluid passage defined by a fluid passage plate which is formed at a side of the pressure chamber, for allowing the ink stored in the ink storing chamber to flow into the pressure chamber, and a nozzle plate attached onto the fluid passage plate and being formed with a plurality of nozzles, for allowing ink to be fired in the form of droplets when the vibrating plate is vibrated, the method comprising the steps of: a first step of determining a voltage inputted when a maximum replacement generating time in the shape memory alloy layer disposed in the ink jet head using shape memory alloy is minimal, as a reference input voltage; a second step of measuring a first time from a reference input voltage supply starting point to a displacement starting point of the shape memory alloy layer; a third step of measuring a second time from after the first time measured in the second step to a point when a displacement of the shape memory alloy layer is maximal; a fourth step of determining a sum of the first and second times which are measured in the second and third steps, respectively, as a reference input voltage applying time; and a fifth step of determining a driving voltage through repeatedly applying different voltages which are less than the reference input voltage determined in the first step and measuring firing velocities and sizes of ink droplets which correspond to the respective voltages.

According to another aspect of the present invention, there is provided a method for optimizing a driving input signal in an ink jet head using shape memory alloy, the ink jet head including a vibrating plate having a shape memory alloy layer and a silicon dioxide layer which are coupled with each other and formed such that it covers space parts which are formed left and right of a substrate, to be vibrated while being changed in its contour depending upon a temperature variation thereof, an electrode formed on the vibrating plate to have a desired pattern, an ink storing chamber defined between the space parts of the substrate for storing ink, a pressure chamber defined on the vibrating plate for containing ink, the pressure chamber discharging ink by vibration of the vibrating plate, a fluid passage defined by a fluid passage plate which is formed at a side of the pressure chamber, for allowing the ink stored in the ink storing chamber to flow into the pressure chamber, and a nozzle plate attached onto the fluid passage plate and being formed with a plurality of nozzles, for allowing ink to be fired in the form of droplets when the vibrating plate is vibrated, the method comprising the steps of: a first step of establishing an input voltage and a voltage applying time such that a velocity of the vibrating plate disposed in the ink jet head using shape memory alloy is maximized; a second step of measuring a velocity and a size of ink droplets in the printer head, at the established input voltage and voltage applying time; a third step of determining whether or not the velocity and the size of ink droplets which are measured in the second step are optimal within design options; and a fourth step of establishing corresponding input voltage and voltage applying time as a waveform of a printer head driving signal when it is determined in the third step that the measured velocity and the size of ink droplets are optimal within the design options, and returning to the second step after reestablishing another input voltage and another voltage applying time when it is determined in the third step that the measured velocity and the size of ink droplets are not optimal within the design options.

According to another aspect of the present invention, there is provided a method for optimizing a driving input signal in an ink jet head using shape memory alloy, the ink jet head including a vibrating plate having a shape memory alloy layer and a silicon dioxide layer which are coupled with each other and formed such that it covers space parts which are formed left and right of a substrate, to be vibrated while being changed in its contour depending upon a temperature variation thereof, an electrode formed on the vibrating plate to have a desired pattern, an ink storing chamber defined between the space parts of the substrate for storing ink, a pressure chamber defined on the vibrating plate for containing ink, the pressure chamber discharging ink by vibration of the vibrating plate, a fluid passage defined by a fluid passage plate which is formed at a side of the pressure chamber, for allowing the ink stored in the ink storing chamber to flow into the pressure chamber, and a nozzle plate attached onto the fluid passage plate and being formed with a plurality of nozzles, for allowing ink to be fired in the form of droplets when the vibrating plate is vibrated, the method comprising the steps of: a first step of determining a voltage inputted when a replacement generating time in the shape memory alloy layer disposed in the ink jet head using shape memory alloy is minimal, as a reference input voltage; a second step of measuring a first time from a reference input voltage supply starting point to a displacement starting point of the shape memory alloy layer; a third step of measuring a second time from after the first time measured in the second step to a point when a displacement of the shape memory alloy layer is maximal; a fourth step of determining a sum of the first and second times which are measured in the second and third steps, respectively, as a reference input voltage applying time; a fifth step of calculating energy applied to the ink jet head, on the basis of the reference input voltage and the reference input voltage applying time which are determined in the first and fourth steps, respectively; and a sixth step of determining a waveform of a driving voltage by measuring a firing velocity and a size of ink droplets while variously controlling a voltage and a voltage applying time, such that energy less than the energy which is calculated in the fifth step is obtained.

According to still another aspect of the present invention, the sixth step comprises: a first process of determining a voltage applying time which corresponds to a firing velocity and a size of ink droplets of a printer head which is to be designed, such that energy less than the energy which is calculated in the fifth step is obtained, and calculating a voltage which corresponds to the voltage applying time; a second process of measuring a firing velocity and a size of the printer head, on the basis of the voltage and voltage applying time which are determined and calculated in the first process, respectively; a third process of determining whether or not data measured in the second process are optimal within design options; and a fourth process of establishing corresponding voltage and voltage applying time as a waveform of a printer head driving signal when it is determined in the third process that the measured velocity and the size of ink droplets are optimal within the design options.

According to yet still another aspect of the present invention, the sixth step further comprises: a fifth process of determining whether energy must be increased or decreased when it is determined in the third process that the measured velocity and the size of ink droplets are not within the design options; and a sixth process of returning to the second process after changing a driving voltage depending upon determination implemented in the fifth process.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
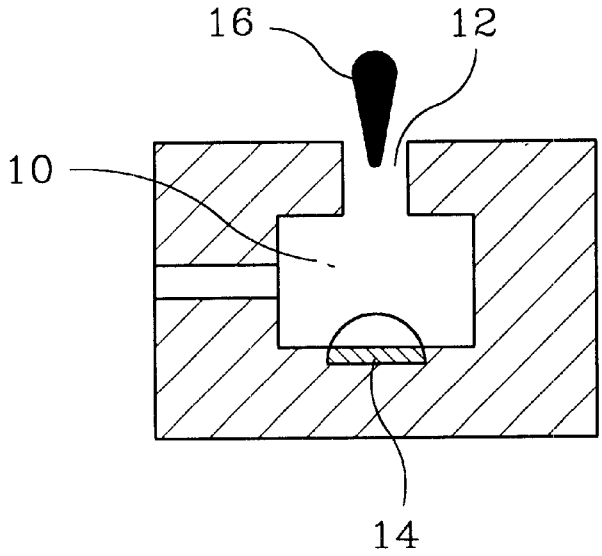
FIG. 1 is a cross-sectional view for explaining an ink firing principle in an ink firing device of a printer head which adopts a heating type firing method.
Figure 2:
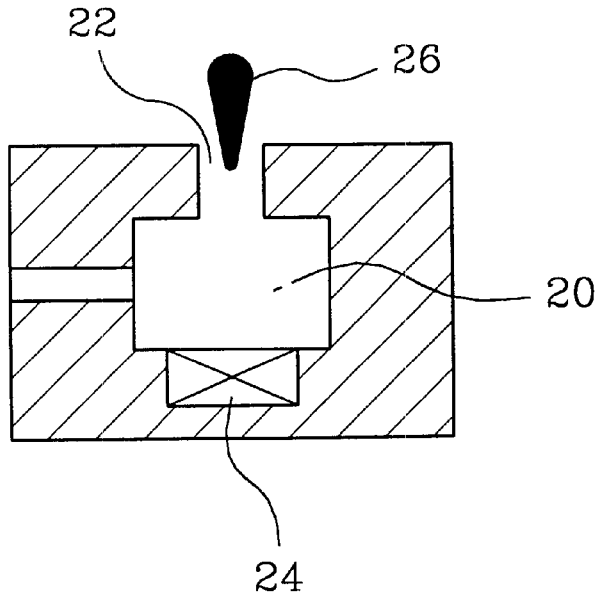
FIG. 2 is a cross-sectional view for explaining an ink firing principle in an ink firing device of a printer head which adopts a vibration type firing method.
Figure 3:
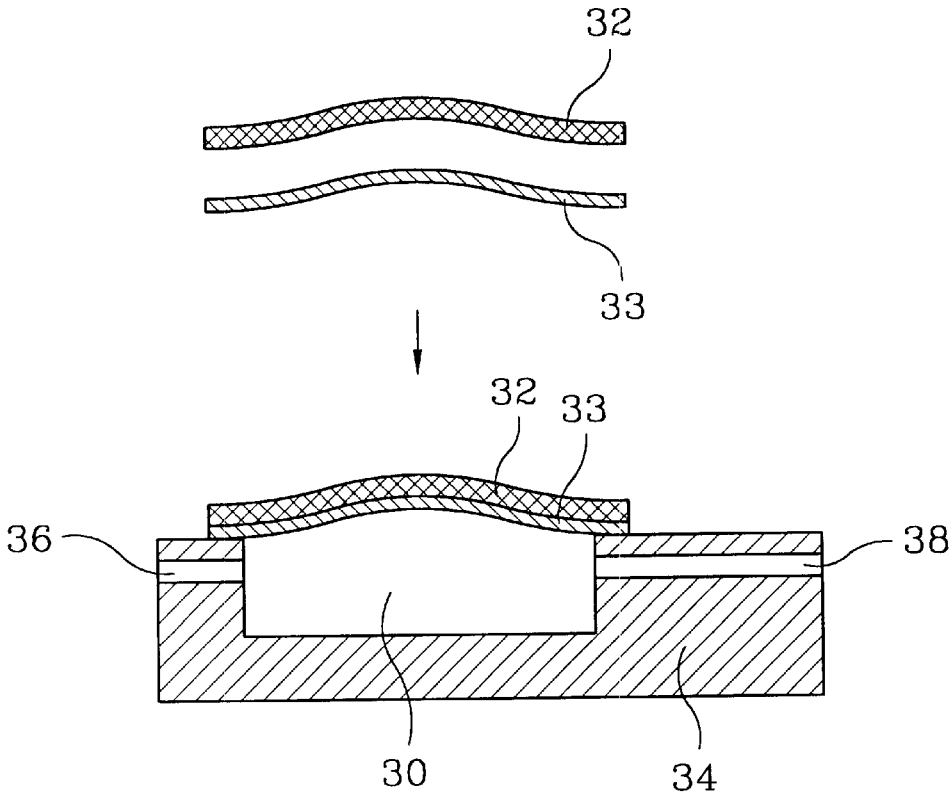
FIG. 3 is a cross-sectional view for explaining an ink firing principle in an ink firing device of a printer head which uses shape memory alloy.
Figure 4:
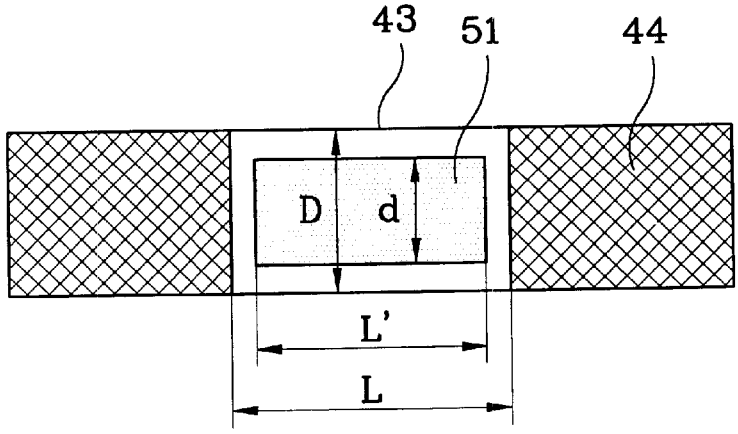
FIG. 4 is a plan view schematically illustrating an actuator section of an ink jet printer head using shape memory alloy, recently disclosed in the art.

Reference will now be made in greater detail to a preferred embodiment of the invention, an example of which is illustrated in the accompanying drawings. Wherever possible, the same reference numerals will be used throughout the drawings and the description to refer to the same or like parts.

First, a technical concept used in the present invention will be described with reference to FIGS. 6 and 7.

Figure 5:
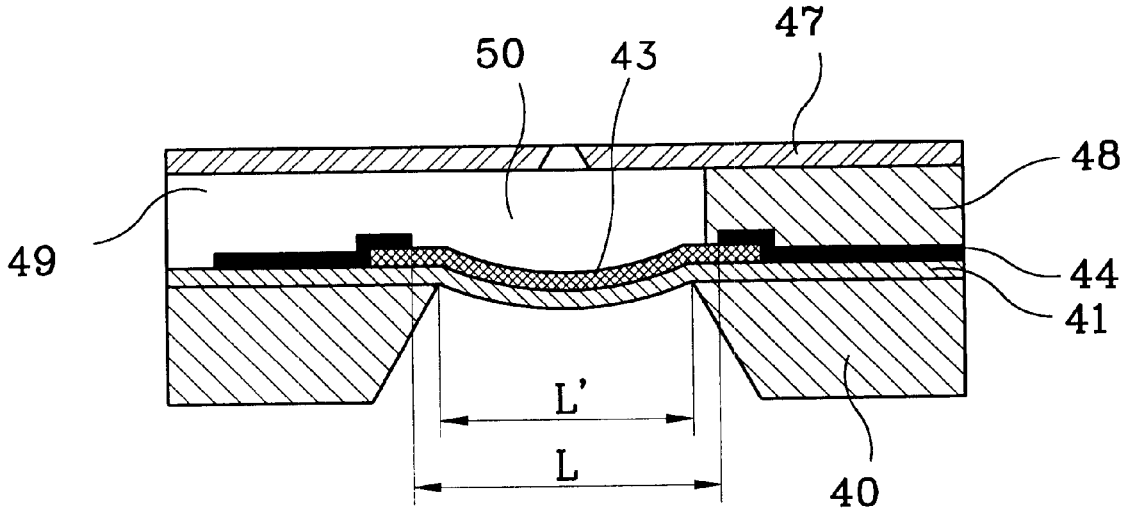
FIG. 5 is a cross-sectional view schematically illustrating an ink firing device section of the ink jet printer head of FIG. 4.
Figure 6:
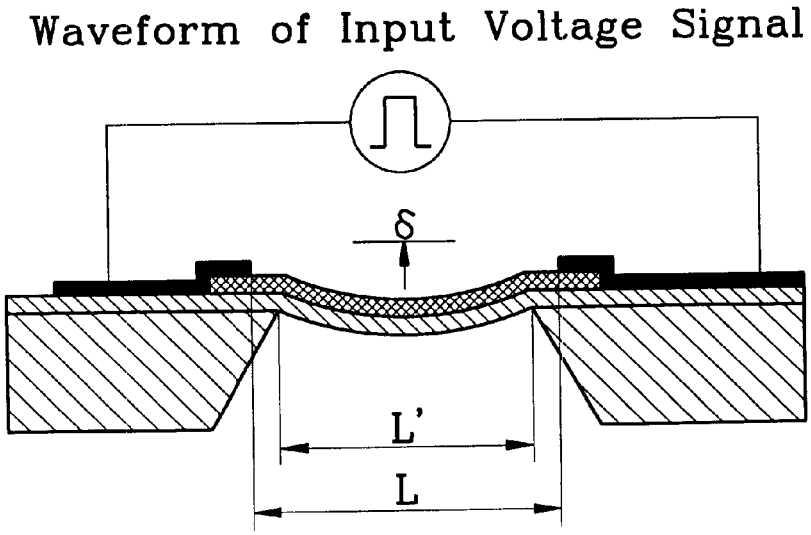
FIG. 6 is a cross-sectional view illustrating a displacement of a shape memory alloy actuator when a voltage is applied to an electrode layer of the ink jet head of FIG. 5.
Figure 7:
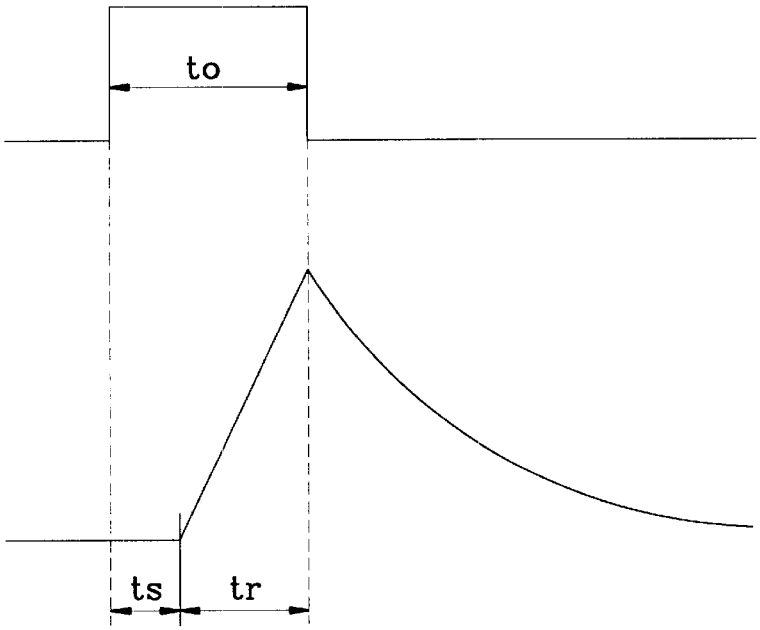
FIG. 7 is a view showing a relationship between an applied voltage and a displacement of a shape memory alloy layer as time is lapsed, in FIG. 6.

FIG. 6 is a cross-sectional view illustrating a displacement of a shape memory alloy actuator when a voltage is applied to an electrode layer of the ink jet head of FIG. 5, and FIG. 7 is a view showing a relationship between an applied voltage and a displacement of a shape memory alloy layer as time is lapsed, in FIG. 6.

As can be seen from FIGS. 6 and 7, in the case of a conventional printer head using shape memory alloy, a displacement δ is generated by voltage pulse which is applied to an electrode 44.

At this time, in FIG. 7, the drawing reference numeral to denotes an applying time of a driving input signal (that is, a voltage applying time), the drawing reference numeral ts denotes a time from a driving input signal applying start time to a transformation start time of the shape memory alloy layer 43, and the drawing reference numeral tr denotes a displacement generating time of the shape memory alloy layer 43.

As a result, a displacement is generated in the shape memory alloy layer 43 due to a temperature variation, and this temperature variation occurs when a voltage which is applied to the electrode 44 is changed. Accordingly, a change in voltage which is applied to the same resistor element is represented by a variation in current which flows through the same resistor element.

Therefore, in the present invention, a waveform of a driving voltage which is applied to heat the ink jet head is optimized, without a structural alteration of the ink jet head using shape memory alloy and without a change in manufacturing processes for the ink jet head using shape memory alloy, thereby improving an ink firing characteristic, in view of the fact that since a displacement and a velocity which are generated in the shape memory alloy layer 43 are related with a contour of a voltage signal waveform which is applied to the electrode 44, optimal velocity and displacement of the vibrating plate can be obtained by adjusting an input voltage signal applying time and a voltage.

A displacement (δ) variation of the shape memory alloy layer 43 depending upon a voltage variation will be described with reference to FIGS. 8 and 9, based on the technical concept according to the present invention as described above.

Figure 8:
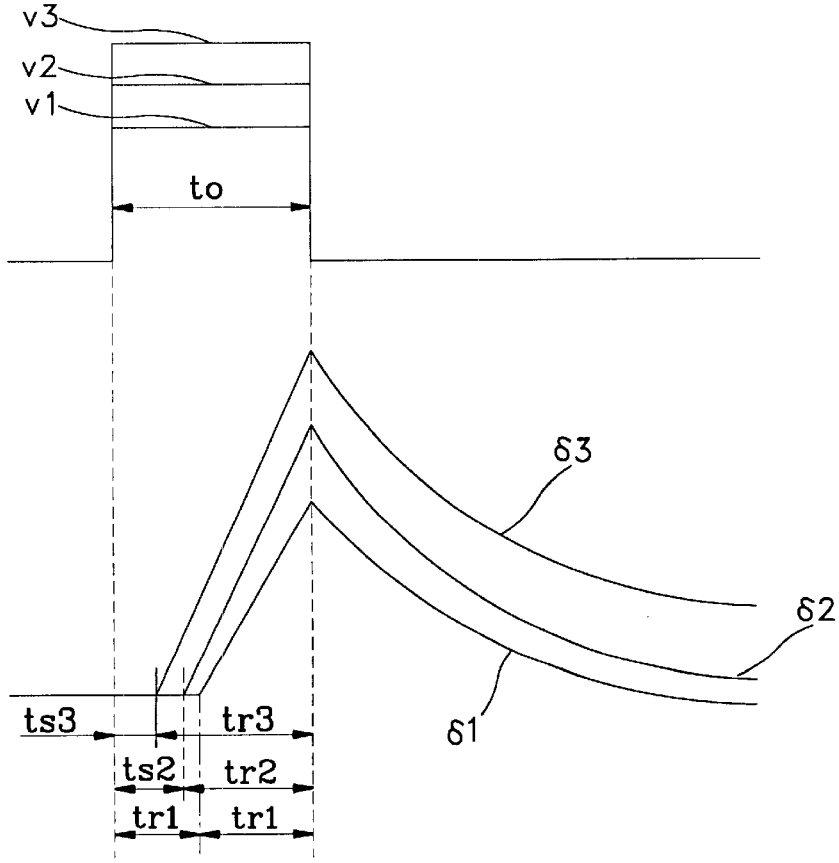
FIG. 8 is a view showing displacement variations as time is lapsed, in the case that a voltage applying time is not changed and an applied voltage is changed when a voltage is applied to an electrode layer of an ink jet head.
Figure 9:
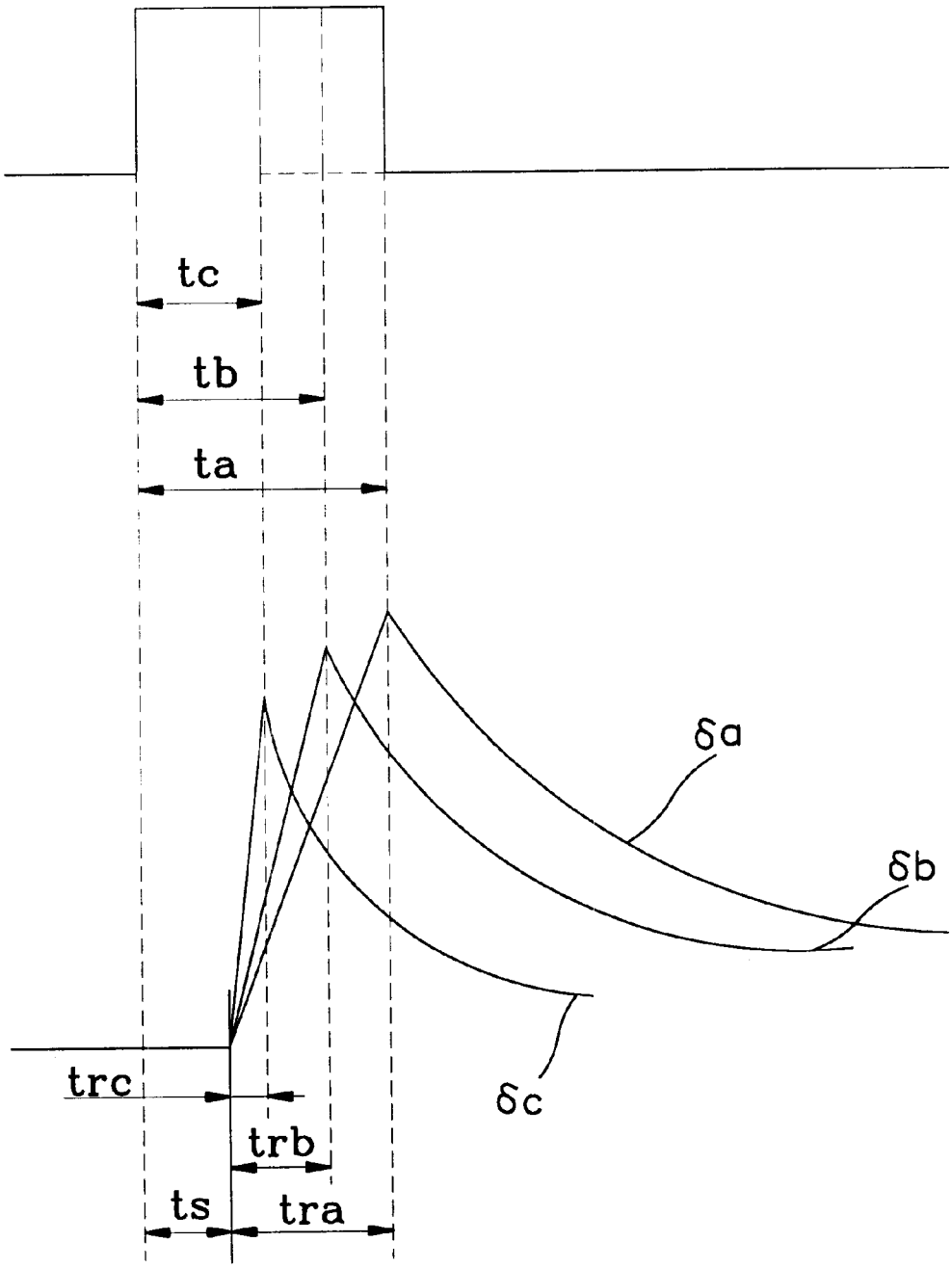
FIG. 9 is a view showing displacement variations as time is lapsed, in the case that an applied voltage is not changed and a voltage applying time is changed when a voltage is applied to an electrode layer of an ink jet head.

FIG. 8 is a view showing displacement variations as time is lapsed, in the case that a voltage applying time is not changed and an applied voltage is changed when a voltage is applied to an electrode layer of an ink jet head, and FIG. 9 is a view showing displacement variations as time is lapsed, in the case that an applied voltage is not changed and a voltage applying time is changed when a voltage is applied to an electrode layer of an ink jet head.

Referring to FIGS. 8 and 9, the drawing reference numeral ts denotes a time from a driving input signal applying start time to a transformation start time of the shape memory alloy layer 43, and the drawing reference numeral tr denotes a displacement generating time of the shape memory alloy layer 43.

When a voltage is increased, ts is decreased, and when a voltage is not changed, ts is not changed. In the case of tr, it is changed depending upon a voltage and a voltage applying time. Accordingly, it is to be readily understood that a displacement (δ) of the vibrating plate is related with a voltage applying time and a magnitude of voltage.

Therefore, in the present invention, by adjusting the driving voltage applying time and the voltage of the ink jet printer using shape memory alloy, desired ink firing efficiency can be accomplished without altering an existing structure.

Figure 10:
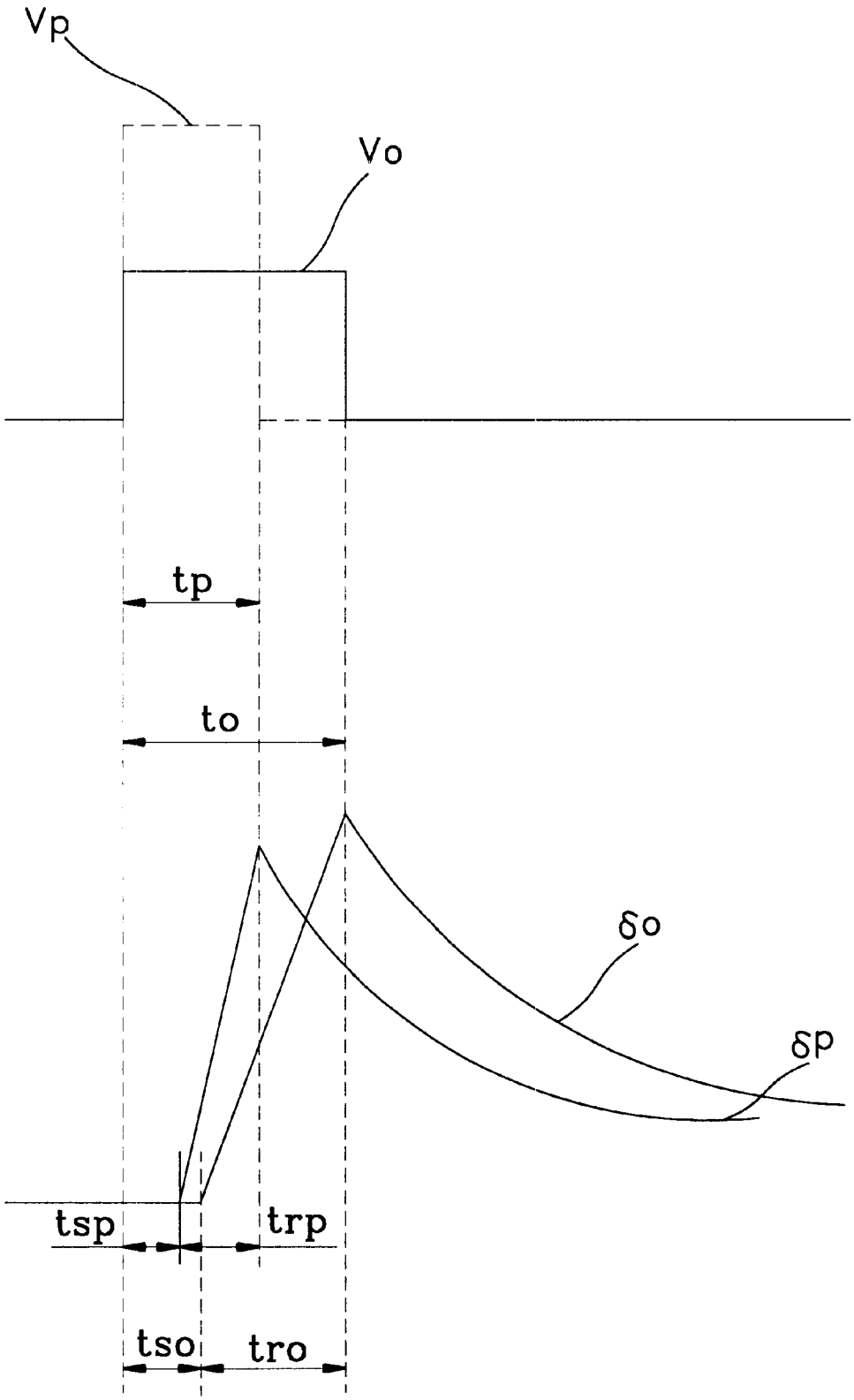
FIG. 10 is a view for explaining a method for optimizing a driving input signal in an ink jet head using shape memory alloy, in accordance with an embodiment of the present invention.

A method for optimizing a driving input signal of the ink jet head using shape memory alloy, which is adopted in the present invention on the basis of the object and the technical concept as described above, is to raise a magnitude of an applying voltage and to shorten a voltage applying time, as shown in FIG. 10.

In FIG. 10, a voltage waveform which is denoted by the drawing reference numeral Vo represents a reference input voltage signal in a driving input signal of the shape memory alloy, and Vp represents a driving input signal having energy which is less than energy generated by a voltage waveform denoted by Vo.

Further, as displacement waveforms which correspond to these voltage signals, a displacement waveform denoted by the drawing reference numeral δo represents a displacement of the shape memory alloy which corresponds to the voltage waveform denoted by the drawing reference numeral Vo, and a displacement waveform denoted by the drawing reference numeral δp represents a displacement of the shape memory alloy which corresponds to the voltage waveform denoted by the drawing reference numeral Vp.

At this time, as shown in FIG. 10, it is to be readily understood that a displacement slope of the shape memory alloy is much steepened when a magnitude of applying voltage is increased and a duration time of the applying voltage is shortened while having energy less than that conventionally generated. This means that a velocity of a center portion of an actuator is increased. Accordingly, a great pressure is generated in the pressure chamber, and by this, a velocity and a size of ink droplets are increased.

EXAMPLE 1

In the present example, a design dimension of a cell is 100×100 μm and 4.5 Ω and a duration time of a voltage is divided into the cases of 10 μsec, 7 μsec and 4 μsec, in each case of which the voltage is changed. Table 1 represents the case that the duration time is 10 μsec, Table 2 represents the case that the duration time is 7 μsec and Table 3 represents the case that the duration time is 4 μsec.

TABLE 1

| Drivinig Voltage [V] | Velocity of Vibrating Plate [mm/sec] | Displacement [μm] |
|---|---|---|
| 7.1 | 40.63 | 0.100 |
| 7.4 | 54.75 | 0.166 |
| 7.7 | 75.00 | 0.266 |
| 8.0 | 103.50 | 0.336 |
| 8.3 | 107.50 | 0.344 |

TABLE 2

| Driving Voltage [V] | Velocity of Vibrating Plate [mm/sec] | Displacement [μm] |
|---|---|---|
| 8.8 | 54.75 | 0.092 |
| 9.1 | 83.25 | 0.153 |
| 9.4 | 110.25 | 0.222 |
| 9.7 | 121.75 | 0.275 |

TABLE 3

| Driving Voltage [V] | Velocity of Vibrating Plate [mm/sec] | Displacement [μm] |
|---|---|---|
| 11.3 | 70.25 | 0.082 |
| 11.6 | 101.50 | 0.113 |
| 11.9 | 144.50 | 0.180 |
| 12.2 | 193.25 | 0.239 |
| 12.5 | 226.50 | 0.285 |

Figure 11:
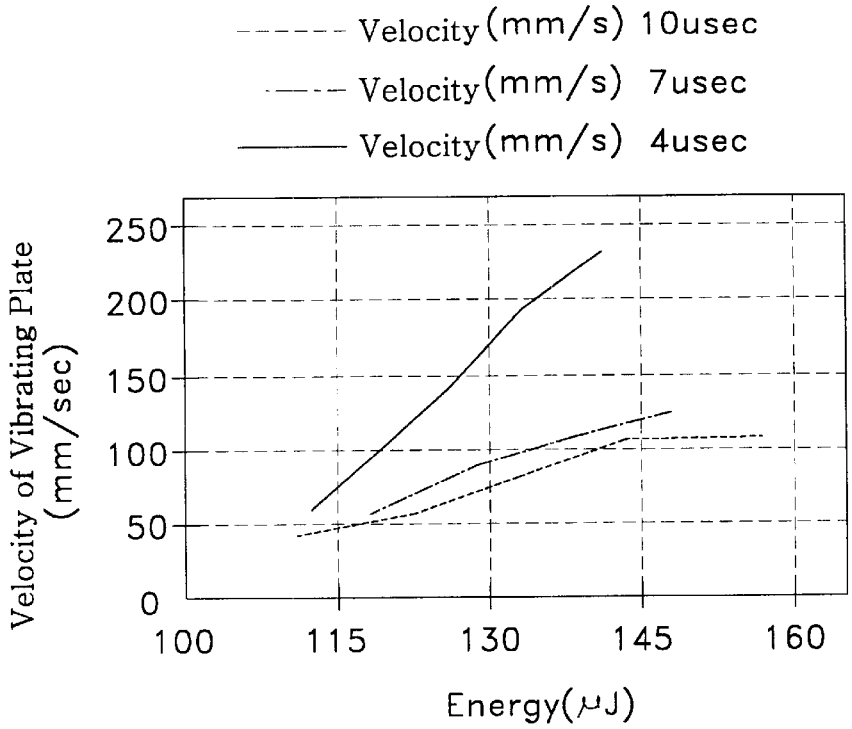
FIG. 11 is a graph showing velocity variations of a center portion of an actuator as the actuator is driven, when a design dimension of a cell is 100×100 μm and 4.5 Ω and when a duration time of a voltage is divided into the cases of 10 μsec, 7 μsec and 4 μsec, in each case of which the voltage is changed.
Figure 12:
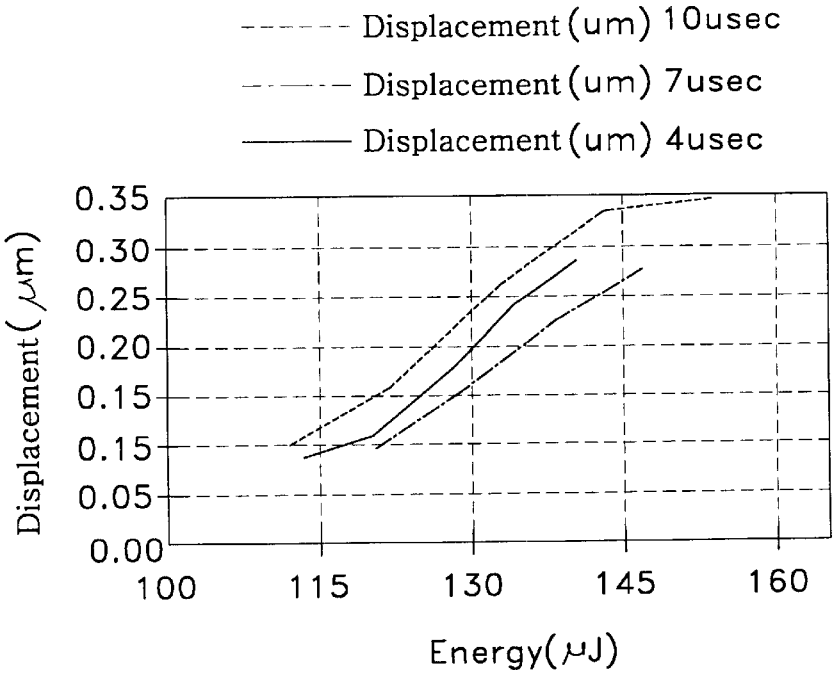
FIG. 12 is a graph showing displacement variations of a center portion of an actuator as the actuator is driven, when a design dimension of a cell is 100×100 μm and 4.5 Ω and when a duration time of a voltage is divided into the cases of 10 μsec, 7 μsec and 4 μsec, in each case of which a voltage is changed.

Among experimental data given in the TABLES 1 through 3, a firing velocity which is changed as the actuator is driven, can be illustrated in a graph as shown in FIG. 11, and among experimental data given in the TABLES 1 through 3, a displacement which is changed as the actuator is driven, can be illustrated in a graph as shown in FIG. 12.

Referring to FIGS. 11 and 12, it is to be noted that when energy is the same, by shortening the duration time of the driving voltage and increasing the magnitude of the voltage, the velocity and displacement of the vibrating plate are increased.

Accordingly, because the velocity of ink droplets is largely influenced by the velocity of the vibrating plate, by shortening the duration time of the driving voltage and applying a great voltage, the velocity of the ink droplets is increased.

Figure 13:
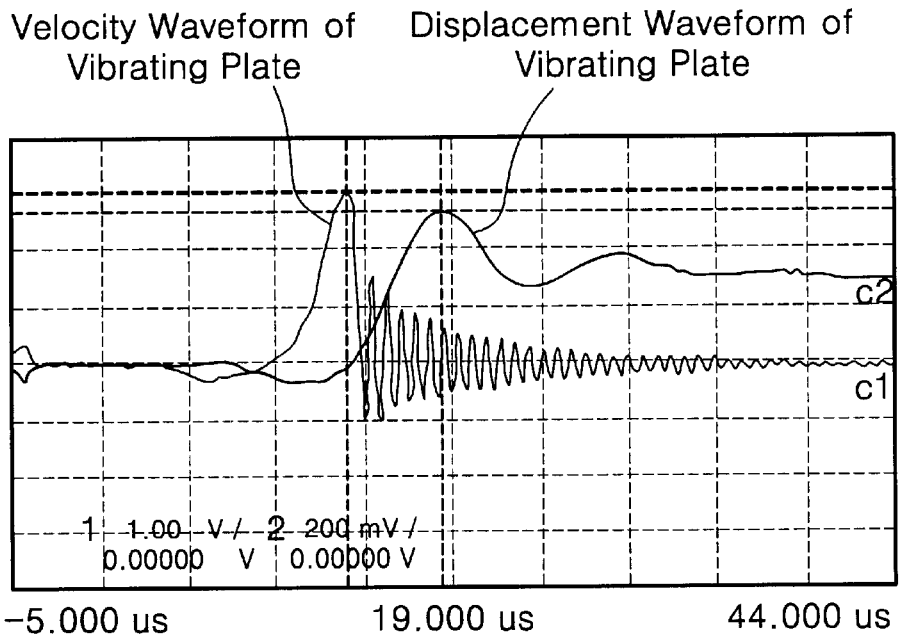
FIG. 13 is a graph showing operating trigger signals, when a design dimension of a cell is 100×100 μm and 4.5 Ω, a duration time of a voltage is 10 μsec and a magnitude of voltage is 7.7 V.
Figure 14:
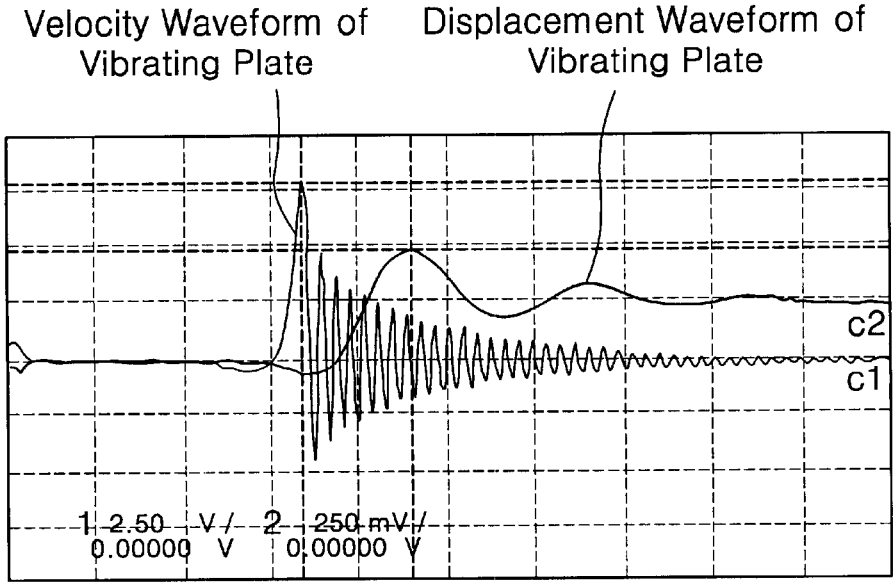
FIG. 14 is a graph showing operating trigger signals, when a design dimension of a cell is 100×100 μm and 4.5 Ω, a duration time of a voltage is 4 μsec and a magnitude of voltage is 12.2 V.

In addition, when observing operation triggers while assuming specified options, they can be illustrated as shown in FIGS. 13 and 14. FIG. 13 is a graph showing operating trigger signals, when a design dimension of a cell is 100×100 μm and 4.5 Ω, a duration time of a voltage is 10 μsec and a magnitude of voltage is 7.7 V, and FIG. 14 is a graph showing operating trigger signals, when a design dimension of a cell is 100×100 μm and 4.5 Ω, a duration time of a voltage is 4 μsec and a magnitude of voltage is 12.2 V.

EXAMPLE 2

In the present example, a design dimension of a cell is 50×50 μm and 6.1 Ω and a duration time of a voltage is divided into the cases of 10 μsec, 7 μsec and 4 μsec, in each case of which the voltage is changed. Table 4 represents the case that the duration time is 10 μsec, Table 5 represents the case that the duration time is 7 μsec and Table 6 represents the case that the duration time is 4 μsec.

TABLE 4

| Driving Voltage [V] | Velocity of Vibrating Plate [mm/sec] | Displacement [μm] |
|---|---|---|
| 12.0 | 56.25 | 0.359 |
| 13.0 | 60.25 | 0.406 |
| 13.5 | 62.50 | 0.445 |
| 14.0 | 65.50 | 0.477 |
| 14.5 | 68.75 | 0.516 |
| 15.0 | 68.00 | 0.555 |

TABLE 5

| Driving Voltage [V] | Velocity of Vibrating Plate [min/sec] | Displacement [μm] |
|---|---|---|
| 14.5 | 77.80 | 0.375 |
| 15.5 | 85.50 | 0.430 |
| 16.5 | 95.63 | 0.469 |
| 17.0 | 98.43 | 0.484 |
| 17.5 | 100.30 | 0.508 |
| 18.0 | 105.93 | 0.508 |
| 18.5 | 110.63 | 0.516 |

TABLE 6

| Driving Voltage [V] | Velocity of Vibrating Plate [mm/sec] | Displacement [μm] |
|---|---|---|
| 17.0 | 112.50 | 0.356 |
| 18.0 | 119.53 | 0.369 |
| 19.0 | 130.08 | 0.363 |
| 20.0 | 135.93 | 0.388 |
| 21.0 | 145.95 | 0.413 |

Figure 15:
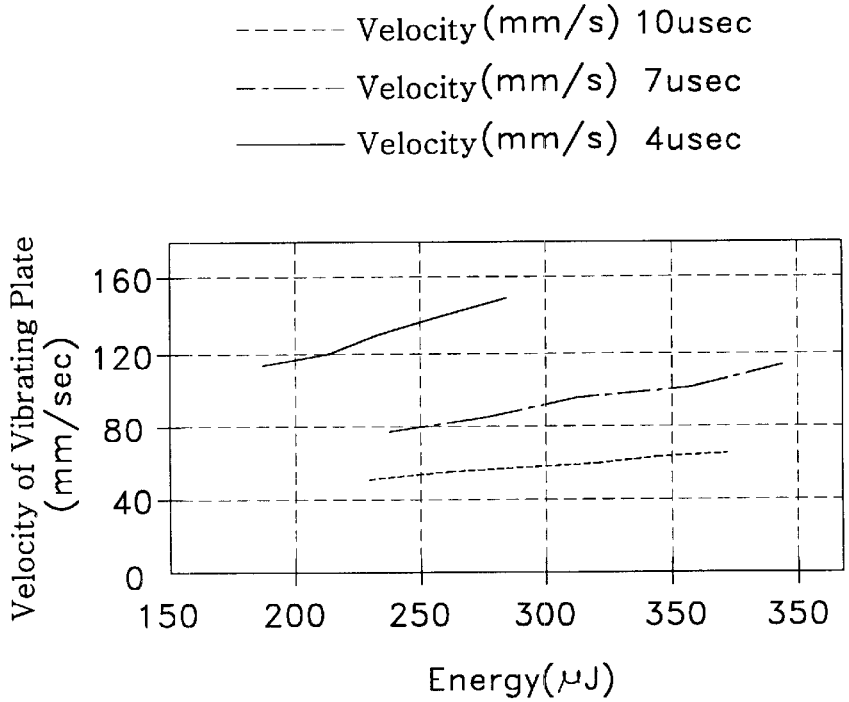
FIG. 15 is a graph showing velocity variations of a center portion of an actuator as the actuator is driven, when a design dimension of a cell is 50×50 μm and 6.1 Ω and when a duration time of a voltage is divided into the cases of 10 μsec, 7 μsec and 4 μsec, in each case of which a voltage is changed.
Figure 16:
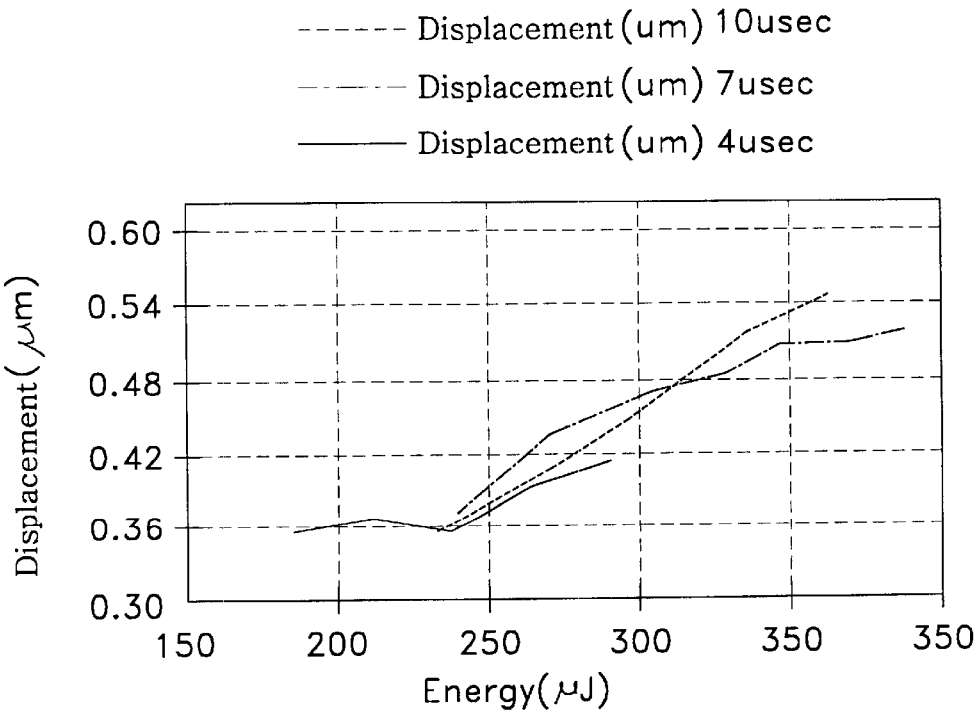
FIG. 16 is a graph showing displacement variations of a center portion of an actuator as the actuator is driven, when a design dimension of a cell is 50×50 μm and 6.1 Ω and when a duration time of a voltage is divided into the cases of 10 μsec, 7 μsec and 4 μsec, in each case of which a voltage is changed.

Among experimental data given in the TABLES 4 through 6, a firing velocity which is changed as the actuator is driven, can be illustrated in a graph as shown in FIG. 15, and among experimental data given in the TABLES 4 through 6, a displacement which is changed as the actuator is driven, can be illustrated in a graph as shown in FIG. 16.

Referring to FIGS. 15 and 16, it is to be noted that when the same energy is applied, by shortening the duration time of the driving voltage and increasing the magnitude of the voltage, the velocity of the vibrating plate is increased and the displacement of the vibrating plate is substantially similarly maintained. Since the velocity of the vibrating plate exerts a potent influence on the firing of ink, the input voltage signal is established such that the velocity of the vibrating plate is increased.

Accordingly, as can be seen from the experimental data based on the technical concept which is applied according to the present invention, when it is desired to change driving efficiency of the printer head using shape memory alloy, by altering a waveform of a driving voltage which is applied to the corresponding printer head while maintaining the same structure, it is possible to obtain desired velocity and size of ink droplets.

Figure 17:
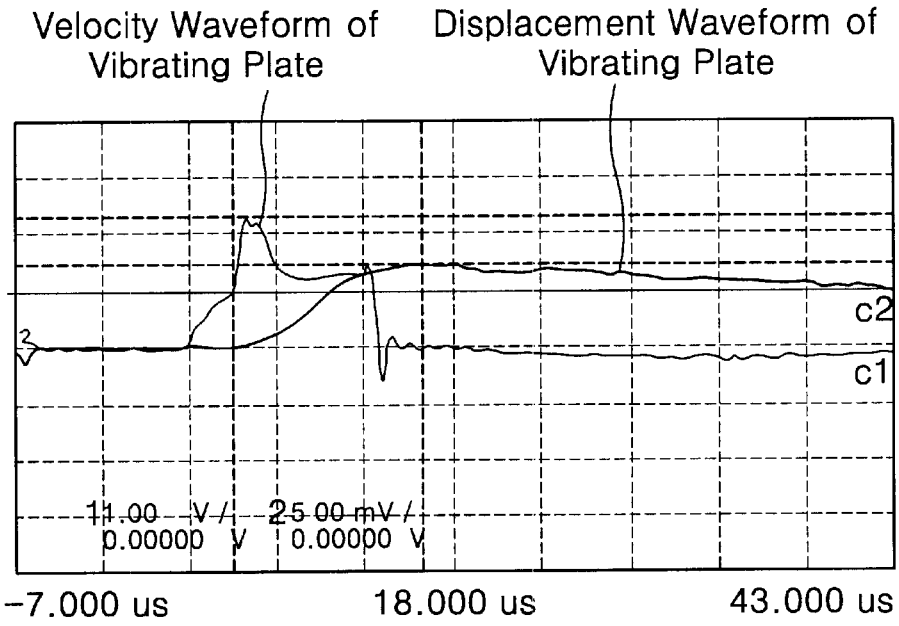
FIG. 17 is a graph showing operating trigger signals, when a design dimension of a cell is 50×50 μm and 6.1 Ω, a duration time of a voltage is 10 μsec and a magnitude of voltage is 12 V.
Figure 18:
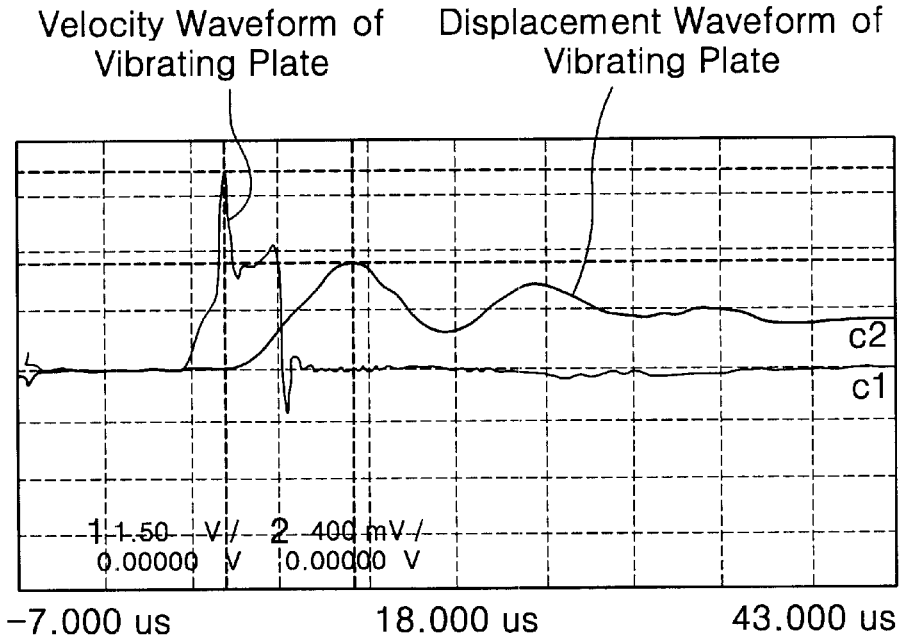
FIG. 18 is a graph showing operating trigger signals, when a design dimension of a cell is 50×50 μm and 6.1 Ω, a duration time of a voltage is 4 μsec and a magnitude of voltage is 19.0 V.

In addition, when observing operation triggers while assuming specified options, they can be illustrated as shown in FIGS. 17 and 18. FIG. 17 is a graph showing operating trigger signals, when a design dimension of a cell is 50×50 μm and 6.1 Ω, a duration time of a voltage is 10 μsec and a magnitude of voltage is 12 V, and FIG. 18 is a graph showing operating trigger signals, when a design dimension of a cell is 50×50 μm and 6.1 Ω, a duration time of a voltage is 4 μsec and a magnitude of voltage is 19.0 V.

As can be seen from the graphs, by shortening the duration time of the applied voltage and raising the magnitude of the corresponding applied voltage, the velocity of the vibrating plate is increased.

Further, as can be seen from the waveform shown in FIG. 10, when the driving voltage of Vo is applied, the waveform of the displacement δ of the shape memory alloy has a much gentle slope. This means that it takes a long time for the shape memory alloy to be cooled after once being heated.

On the contrary, in the case that the duration time is shortened and the magnitude of the voltage is increased in FIG. 10 according to the present invention, that is, when the driving voltage of Vp is applied, since the waveform of the displacement δp of the shape memory alloy has a much steep slope, the printer head using shape memory alloy is prevented from being overheated when firing ink at high frequency.

According to the present invention, a procedure for optimizing a driving input signal in an ink jet head using shape memory alloy can be performed in the sequence as described below.

Step 1: First, a printer head using conventional shape memory alloy is prepared and then, a driving voltage Vo of the printer head is determined (at this time, the driving voltage Vo is determined by a conventional way, depending upon a structure of the printer head).

Step 2: If the reference input voltage Vo is determined as described above, a time ts is measured, from a time when the reference input voltage Vo is initially applied to a time when the shape memory alloy layer 43 is initially deformed.

Step 3: If ts is measured, a minimal displacement generating time tr is measured, from after the time measured in Step 2 to a time when a displacement of the shape memory alloy layer 43 is maximal.

Step 4: Accordingly, a voltage applying time to is expressed by ts+tr.

Thereafter, two methods can be used. One method is to adjust the displacement of the shape memory alloy layer 43 simply by varying the magnitude of voltage, and the other method is to adjust the displacement of the shape memory alloy layer 43 by varying both of the voltage applying time and the magnitude of voltage. At this time, explanations given below will be concentrated into the other method as being a preferred embodiment of the present invention.

Step 5: Energy which is applied to the ink jet head is calculated, on the basis of the voltage applying time to which is obtained through Step 4 and the magnitude of voltage Vo which is determined in Step 1.

Step 6: A voltage applying time tp which corresponds to a firing velocity and a size of ink droplets to be designed is determined such that energy less than the energy which is calculated in Step 5 is obtained, and a magnitude of voltage Vp which corresponds to the voltage applying time tp is calculated.

Step 7: A firing velocity and a size of ink droplets are measured depending upon the calculated magnitude of voltage Vp and the voltage applying time tp.

Step 8: It is determined whether or not the data measured in Step 7 are within design options.

Step 9: When it is determined in Step 8 that the data measured in Step 7 are optimal within the design options, the corresponding magnitude of voltage and the voltage applying time are established as a waveform of the printer head driving signal.

Step 10: When it is determined in Step 8 that the data measured in Step 7 are not within the design options, it is determined whether energy must be increased or decreased, and the program is returned to Step 7 after changing the magnitude of the driving voltage Vp and the voltage applying time.

Entire voltage applying time is within a range of 1–50 $\mu$s.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A method for optimizing a driving input signal in an ink jet head using shape memory alloy, the ink jet head including a vibrating plate having a shape memory alloy layer and a silicon dioxide layer which are coupled with each other and formed to cover space parts which are formed left and right of a substrate, to be vibrated while the vibrating plate is changed in contour depending upon a temperature variation thereof, an electrode formed on the vibrating plate to have a desired pattern, an ink storing chamber defined between the space parts of the substrate for storing ink, a pressure chamber defined on the vibrating plate for containing ink, the pressure chamber discharging ink by vibration of the vibrating plate, a fluid passage defined by a fluid passage plate which is formed at a side of the pressure chamber, for allowing the ink stored in the ink storing chamber to flow into the pressure chamber, and a nozzle plate attached onto the fluid passage plate and being formed with a plurality of nozzles, for allowing ink to be fired in the form of droplets when the vibrating plate is vibrated, the method comprising the steps of:

(a) determining a voltage inputted when a maximum replacement generating time in the shape memory alloy layer is minimal, as a reference input voltage;

(b) measuring a first time from a reference input voltage supply starting point to a displacement starting point of the shape memory alloy layer;

(c) measuring a second time starting after the first time measured in step (b) to a point when a displacement of the shape memory alloy layer is maximal;

(d) determining a sum of the first and second times which are measured in steps (b) and (c), respectively, as a reference input voltage applying time; and (e) determining a driving voltage through repeatedly applying different voltages which are less than the reference input voltage determined in step (a) and measuring firing velocities and sizes of ink droplets which correspond to the respective voltages.

2. A method for optimizing a driving input signal in an ink jet head using shape memory alloy, the ink jet head including a vibrating plate having a shape memory alloy layer and a silicon dioxide layer which are coupled with each other and formed to cover space parts which are formed left and right of a substrate, to be vibrated while the vibrating plate is changed in contour depending upon a temperature variation thereof, an electrode formed on the vibrating plate to have a desired pattern, an ink storing chamber defined between the space parts of the substrate for storing ink, a pressure chamber defined on the vibrating plate for containing ink, the pressure chamber discharging ink by vibration of the vibrating plate, a fluid passage defined by a fluid passage plate which is formed at a side of the pressure chamber, for allowing the ink stored in the ink storing chamber to flow into the pressure chamber, and a nozzle plate attached onto the fluid passage plate and being formed with a plurality of nozzles, for allowing ink to be fired in the form of droplets when the vibrating plate is vibrated, the method comprising the steps of:

(a) establishing an input voltage and a voltage applying time such that a velocity of the vibrating plate is maximized;

(b) measuring a velocity and a size of ink droplets in the printer head, at the established input voltage and voltage applying time;

(c) determining whether or not the velocity and the size of ink droplets which are measured in step (b) are optimal within design options; and (d) establishing corresponding input voltage and voltage applying time as a waveform of a printer head driving signal when it is determined in step (c) that the measured velocity and the size of ink droplets are optimal within the design options, and returning to step (b) after reestablishing another input voltage and another voltage applying time when it is determined in step (c) that the measured velocity and the size of ink droplets are not optimal within the design options.

3. A method for optimizing a driving input signal in an ink jet head using shape memory alloy, the ink jet head including a vibrating plate having a shape memory alloy layer and a silicon dioxide layer which are coupled with each other and formed to cover space parts which are formed left and right of a substrate, to be vibrated while the vibrating plate contour is changed depending upon a temperature variation thereof, an electrode formed on the vibrating plate to have a desired pattern, an ink storing chamber defined between the space parts of the substrate for storing ink, a pressure chamber defined on the vibrating plate for containing ink, the pressure chamber discharging ink by vibration of the vibrating plate, a fluid passage defined by a fluid passage plate which is formed at a side of the pressure chamber, for allowing the ink stored in the ink storing chamber to flow into the pressure chamber, and a nozzle plate attached onto the fluid passage plate and being formed with a plurality of nozzles, for allowing ink to be fired in the form of droplets when the vibrating plate is vibrated, the method comprising the steps of:

(a) determining a voltage inputted when a replacement generating time in the shape memory alloy layer is minimal, as a reference input voltage;

(b) measuring a first time from a reference input voltage supply starting point to a displacement starting point of the shape memory alloy layer;

(c) measuring a second time starting after the first time measured in step (b) to a point when a displacement of the shape memory alloy layer is maximal;

(d) a determining a sum of the first and second times which are measured in steps (b) and (c), respectively, as a reference input voltage applying time;

(e) calculating energy applied to the ink jet head, according to the reference input voltage and the reference input voltage applying time which are determined in the steps (a) and (d), respectively; and (f) determining a waveform of a driving voltage by measuring a firing velocity and a size of ink droplets while variously controlling a voltage and a voltage applying time, such that energy less than the energy which is calculated in step (e) is obtained.

4. A method as claimed in claim 3, wherein step (f) comprises:

(g) determining a voltage applying time which corresponds to a firing velocity and a size of ink droplets of a printer head which is to be designed, such that energy less than the energy which is calculated in step (e) is obtained, and calculating a voltage which corresponds to the voltage applying time;

(h) measuring a firing velocity and a size of ink droplets of the printer head, on the basis of the voltage and voltage applying time which are determined and calculated in step (g), respectively;

(i) determining whether or not data measured in step (h) are optimal within design options; and (j) establishing corresponding voltage and voltage applying time as a waveform of a printer head driving signal when it is determined in step (i) that the measured velocity and the size of ink droplets are optimal within the design options.

5. A method as claimed in claim 4, wherein step (f) further comprises:

(k) determining whether energy must be increased or decreased when it is determined step (i) that the measured velocity and the size of ink droplets are not within the design options; and (l) returning to step (h) after changing a driving voltage depending upon determination implemented in step (k).

6. A method as claimed in claim 4, wherein the voltage applying time in step (g) is within 1–50 $\mu$s.

7. A method as claimed in claim 3, wherein the voltage applying time in step (f) is within 1–50 $\mu$s.

* * * * *